US009174766B2

(12) United States Patent
Kosonen et al.

(10) Patent No.: US 9,174,766 B2
(45) Date of Patent: Nov. 3, 2015

(54) ADAPTOR PALLET AND METHOD OF TRANSPORTING A PLURALITY OF DOLLIES BY MEANS OF AN ADAPTOR PALLET

(71) Applicant: K. Hartwall Oy Ab, Söderkulla (FI)

(72) Inventors: Juha Kosonen, Söderkulla (FI); Mikko Järvi, Söderkulla (FI); Johan Lindström, Söderkulla (FI); Jussi Raninen, Söderkulla (FI); Markku Tiilikainen, Söderkulla (FI); Thomas Nyholm, Söderkulla (FI); Eero Korhonen, Söderkulla (FI)

(73) Assignee: K. Hartwall Oy Ab, Söderkulla (FI)

( * ) Notice: Subject to any disclaimer, the term of this patent is extended or adjusted under 35 U.S.C. 154(b) by 0 days.

(21) Appl. No.: 14/277,958

(22) Filed: May 15, 2014

(65) Prior Publication Data

US 2014/0366783 A1 Dec. 18, 2014

(51) Int. Cl.

| | |
|---|---|
| ***B65D 19/00*** | (2006.01) |
| ***B65D 19/44*** | (2006.01) |
| ***B65D 19/38*** | (2006.01) |

(52) U.S. Cl.

CPC ..... *B65D 19/0002* (2013.01); *B65D 19/0095* (2013.01); *B65D 19/38* (2013.01); *B65D 19/44* (2013.01); *B65D 2519/00273* (2013.01);

(Continued)

(58) Field of Classification Search

CPC ..... B65D 19/002; B65D 19/38; B65D 19/44; B65D 85/68; B65D 2585/686; B65D 2519/00323; B65D 2519/00333; B65D 2519/00815; B65G 1/026

USPC ..... 108/51.11, 57.15, 57.32

See application file for complete search history.

(56) References Cited

U.S. PATENT DOCUMENTS 5,822,829 A * 10/1998 Webb et al. ..... 16/30
2006/0013991 A1* 1/2006 Hoogland ..... 428/119

(Continued)

FOREIGN PATENT DOCUMENTS

DE 202006007202 U1 9/2006
DE 202009017927 U1 5/2011

(Continued)

OTHER PUBLICATIONS

Finnish Office Action for Patent Application No. 20135651, issued Feb. 28, 2014, 5 pages.

*Primary Examiner* — Hanh V Tran

(74) *Attorney, Agent, or Firm* — Chernoff, Villhauer, McClung & Stenzel, LLP

(57) ABSTRACT

An adaptor pallet and a method for transporting a plurality of dollies without compromising occupational safety. The novel adaptor pallet includes a base and two lifting structures. The base is shaped to receive adjacent wheels of at least two parallel dollies. The lifting structures are arranged extend from both sides of the base so as to receive a lifting device for directly supporting the weight of the dolly from beneath upon lifting motion of the adaptor pallet by means of a lifting device.

15 Claims, 4 Drawing Sheets

(52) U.S. Cl.
CPC ..... *B65D2519/00293* (2013.01); *B65D 2519/00323* (2013.01); *B65D 2519/00333* (2013.01); *B65D 2519/00815* (2013.01)

(56) References Cited

U.S. PATENT DOCUMENTS

| | | | | |
|---|---|---|---|---|
| 2009/0175698 | A1* | 7/2009 | Overbye | 410/4 |
| 2010/0310352 | A1* | 12/2010 | Moberg | 414/800 |

FOREIGN PATENT DOCUMENTS

| | | | | |
|---|---|---|---|---|
| DE | 202012007740 | U1 | 5/2011 | |
| DE | 202011106718 | U1 * | 3/2012 | B65D 19/44 |
| DE | 202011000477 | U1 | 9/2012 | |
| DE | 102011054255 | A1 | 4/2013 | |
| DE | 102013002481 | A1 | 8/2014 | |
| GB | 2416527 | A | 2/2006 | |
| WO | 2009/090309 | A1 | 7/2009 | |

* cited by examiner

ADAPTOR PALLET AND METHOD OF TRANSPORTING A PLURALITY OF DOLLIES BY MEANS OF AN ADAPTOR PALLET

CROSS-REFERENCE TO RELATED APPLICATIONS

This application claims priority under 35 U.S.C. §119 to Finnish Patent Application No. 20135651, filed Jun. 14, 2013.

FIELD OF THE INVENTION

The present invention relates to logistics equipment. In particular, the invention relates to an adaptor pallet and method for transporting and storing a plurality of wheeled dollies.

BACKGROUND OF THE INVENTION

Goods of relatively small size are typically transported using wheeled dollies which are platforms mounted on wheels or castors. Goods are stored in containers that fit into the receptive platform. Upon transportation or temporary storage, the usually boxlike containers are stacked onto dollies whose wheels enable easy handling by hand. The shape and size of the dollies are usually standardized to conform advantageously to industrial container models. While the dollies may be moved about by hand, there is also a need to transport a plurality of dollies at once. Such a need occurs e.g. when loading or unloading a trailer or a lorry. If a trailer is loaded dolly by dolly, the long duration of the operation consumes valuable docking time not to mention inflicted gratuitous vehicle idle time. Also, when transported individually, the dollies require thorough and tedious trussing up to prevent unintended movement within the load space. To tackle these disadvantages, adaptor pallets have been developed.

There is also a need to secure the dollies to the adaptor pallet. A conventional adaptor pallet comprises a base with two outer tracks for receiving the outer wheels of dollies in two parallel files and two adjacent inner tracks for receiving the inner wheels of said dollies. Between both outer and inner tracks, there is a lifting structure elevated from the tracks and connected to them by means of vertical supports. The horizontal lifting structure and its vertical supports form two parallel galleries for receiving the lifting forks of a forklift for elevating the adaptor pallet from the ground.

In order to prevent the dollies from falling off the adaptor pallet, many different securing devices have been developed over. Without such securing devices, the adaptor pallets might not conform to regulations concerning occupational safety. The securing devices may be divided into two main types. The first type is an adaptor pallet having an open loading end, whereby the dollies are secured to the pallet by operating special locking fins or similar locking elements which are toggled between locked and released position by manipulation means which may take the form of a foot-operated lever or a hand-operated handle. A foot-operated lever is proposed for leaving the operator's hand free to manipulate the loaded dolly.

It is an aim of the present invention to provide a simplified adaptor pallet and method for transporting a plurality of dollies without compromising occupational safety.

BRIEF SUMMARY OF THE INVENTION

The aim of the present invention is achieved with aid of a novel adaptor pallet including a base and two lifting structures. The base is shaped to receive adjacent wheels of at least two parallel dollies. The lifting structures are arranged extend from both sides of the base so as to receive a lifting device for directly supporting the weight of the dolly from beneath upon lifting motion of the adaptor pallet by means of a lifting device.

The aim is on the other hand achieved with a novel method of transporting a plurality of dollies by means of an adaptor pallet. In the method wheels of the plurality of dollies is received to a base of the adaptor pallet, whereby the lifting structures are raised from beneath by means of a lifting device or devices. Upon the lifting motion, angular movement is caused between the base and lifting structures for contacting the lifting structures with chassis of the dollies from beneath, whereby the weight of the dollies is supported directly from the chassis of the dollies via the lifting structures.

Considerable benefits are gained with aid of the present invention. By carrying the weight of the dolly by means of the lifting structure instead of the wheel tracks of the base, the adaptor pallet may be made simpler by omitting the outer tracks for receiving the outside wheels of the dolly. For the same reasons, the dolly is also lighter, which improves the carbon footprint of the device.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

In the following, exemplary embodiments of the invention are described in greater detail with reference to the accompanying drawings in which.

DETAILED DESCRIPTION OF EXEMPLARY EMBODIMENTS

Figure 1:
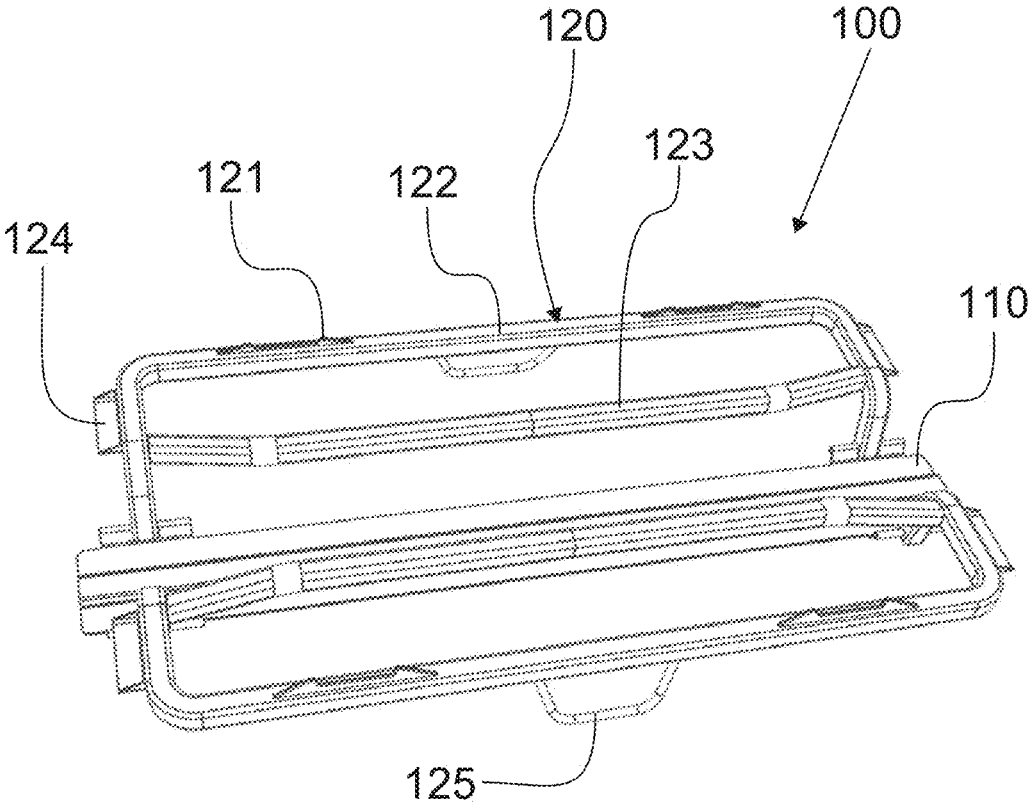
FIG. 1 presents an isometric top view of an adaptor pallet according to one embodiment.
Figure 2A:
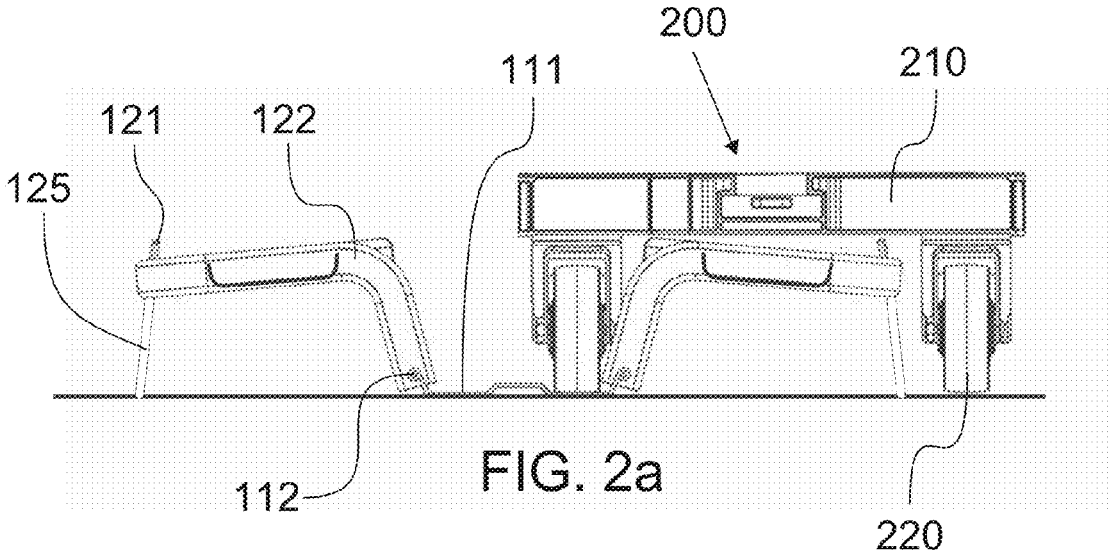
FIG. 2*a* presents a frontal view of the adaptor pallet of FIG. 1 in a released configuration and provided with one dolly.
Figure 2B:
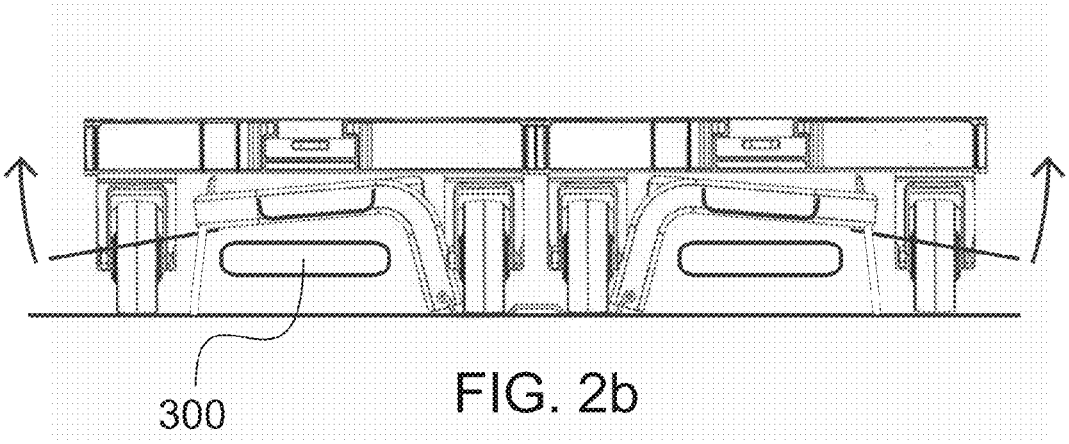
FIG. 2*b* presents a frontal view of the adaptor pallet of FIG. 2*a* provided with two parallel dollies.
Figure 2C:
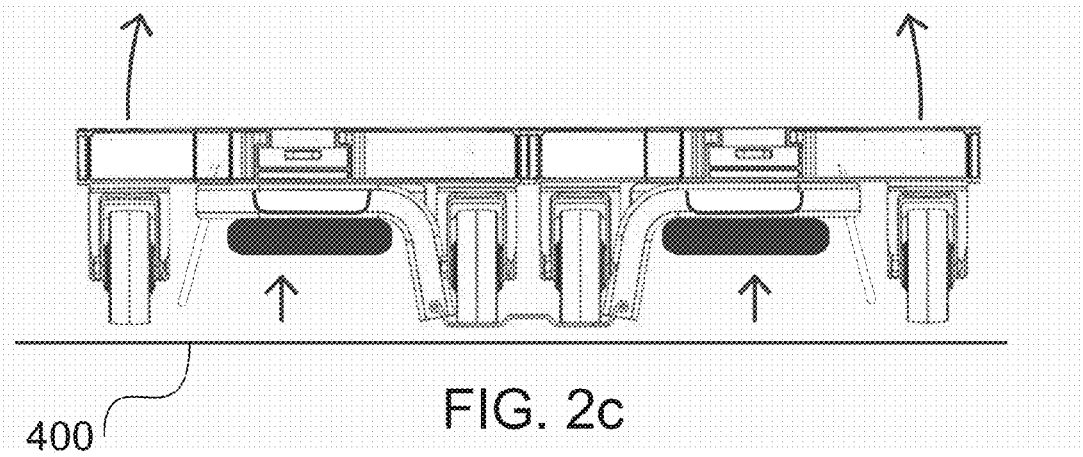
FIG. 2*c* presents a frontal view of the adaptor pallet of FIG. 2*b* in a secured configuration.
Figure 3A:
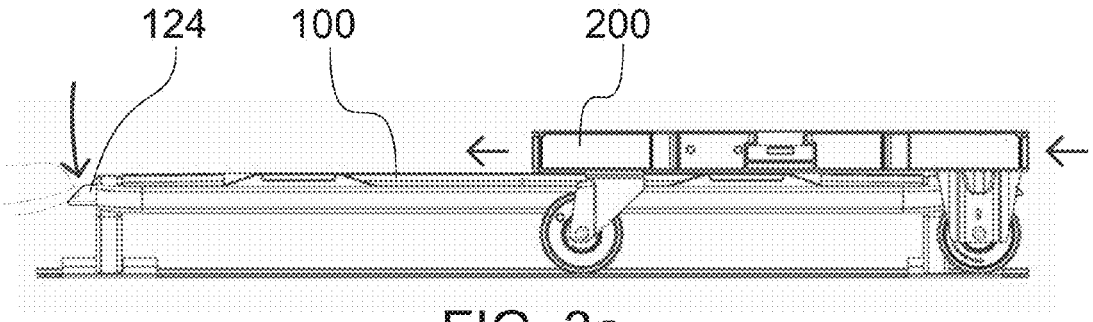
FIG. 3*a* presents a side view of the adaptor pallet of FIG. 2*a*.
Figure 3B:
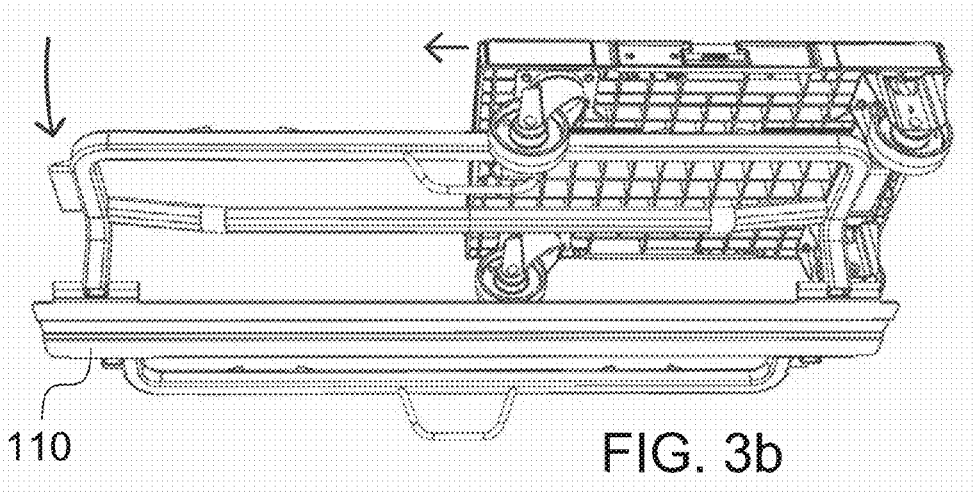
FIG. 3*b* presents an isometric bottom view of the adaptor pallet of FIG. 2*a*.
Figure 3C:
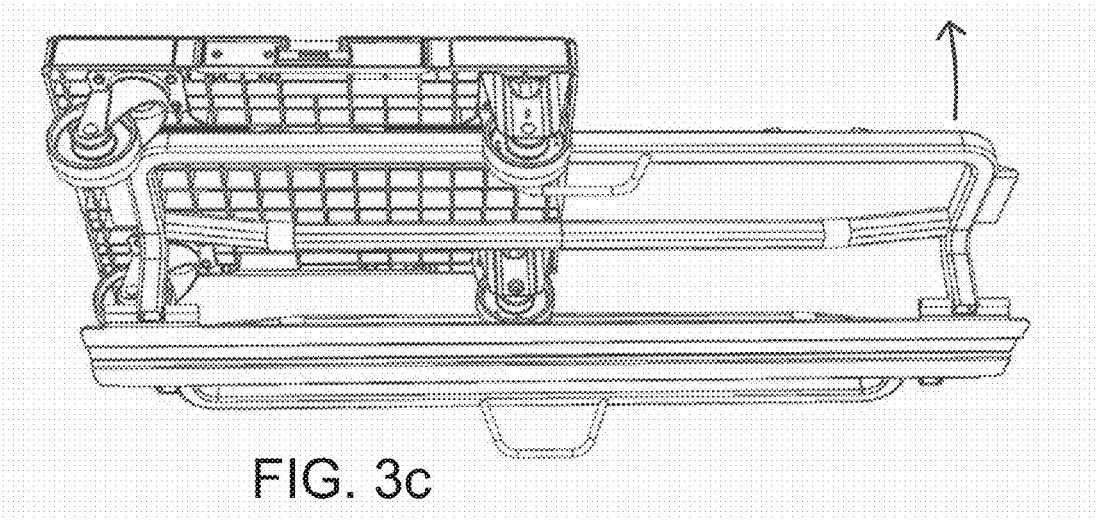
FIG. 3*c* presents an isometric bottom view of the adaptor pallet of FIG. 2*a* in a secured configuration.

As can be seen from the drawings FIG. 1 to FIG. 4, the novel adaptor pallet 100 according to one embodiment includes a base 110 and two lifting structures 120, which are hinged to the base 110. The base 110 is shaped to receive adjacent wheels 220 of at least two parallel dollies 200 (FIGS. 2*b* and 2*c*). The base 110 is particularly shaped to include two parallel tracks 111 separated by a longitudinal boss. In this context, the term longitudinal is meant to refer to the predominant extension of the base 110, i.e. the direction in which the dollies 200 are moved along the tracks 111. This direction is indicated by the straight arrows in FIGS. 3*a* and 3*b*. While the base 110 could alternatively be flat and dimensioned to fit the wheels of two neighboring dollies 200, it is advisable to construct the base 110 to feature parallel distinguishable tracks 111 or recesses for aiding the movement of the dollies 200 in said longitudinal direction. The base 110 illustrated in the drawings is configured to receive the adjacent wheels of four dollies. More precisely, the base 110 has two parallel tracks 111, whereby one track receives the successive four wheels of two dollies in one file and the other adjacent track receives the successive four wheels of corresponding two dollies in an adjacent file. A matrix of two-by-two is thus formed. As may also be seen, the base 110 only has two tracks, whereby it is lacking the traditional "outer tracks" for the rest of the wheels of the plurality of dollies 200.

Arranged to the base 110 are two lifting structures 120, which are on both sides of the base 110, i.e. one on either side of the base 110. The sides in this context refer to the peripheries of the base 110 that run along the longitudinal direction. The lifting structures 120 extend from the base 110 so as to receive a lifting device 300, particularly the lifting forks of a fork lift, for lifting the adaptor pallet 100 from beneath. The lifting structure 120 has a frame 122, which is bent (as shown in the drawings) or assembled from individual components to feature two articulated arm portions, which are pivotably arranged to opposing ends of the base 110. These ends are particularly the opposing ends of the base 110 defined by the predominant extension of the base 110. The arm portions extend up and away from the base 110 to opposite orthogonal directions so as to form an open-ended gallery for receiving the lifting forks. The arm portions are connected by an extending portion of the frame 122, which extends between in the longitudinal direction. Parallel to the extending portion, a reinforcement beam 123 has been arranged for guiding and positioning the dollies along the longitudinal direction as well as for improving rigidity to the lifting structure 120. The engaging surface of the frame 122, i.e. the top surface, is provided with interlocking forms 121. The interlocking forms 121 are intended as form-fitting counterparts for cooperating with similar or inverted forms provided to the dolly, which is discussed here after. The interlocking forms 121 of the lifting structure 120 feature successive and separated fins, which protrude from the frame 122 and which are chamfered, rounded or otherwise draught for assisting the movement between the dolly 200 and lifting structure 120, when there is little or no contact between the two. To the terminal end in the longitudinal direction, a pedal 124 has been provided for to the lifting structure 124 for manipulating it in respect to the base 110 in a manner elaborated in the following.

The lifting structure 120 is arranged movably to the base 110. More particularly, the lifting structure 120 is pivoted to the base 110 by means of a hinge, which connects the articulated arm portion of the frame 122 to the base 110 for allowing angular movement between the two about an axis, which is parallel to the longitudinal direction, i.e. parallel to the direction of the predominant extension of the base 110. According to a further embodiment, the hinge is suspended by means of a spring for biasing the lifting structure 120 such to raise the articulated arm portions towards an upright position and therefore to make the extending portion of the frame 122 as horizontal as possible. This serves the purpose of biasing the lifting structure towards a dolly 200 provided to the base 110.

Figure 4:
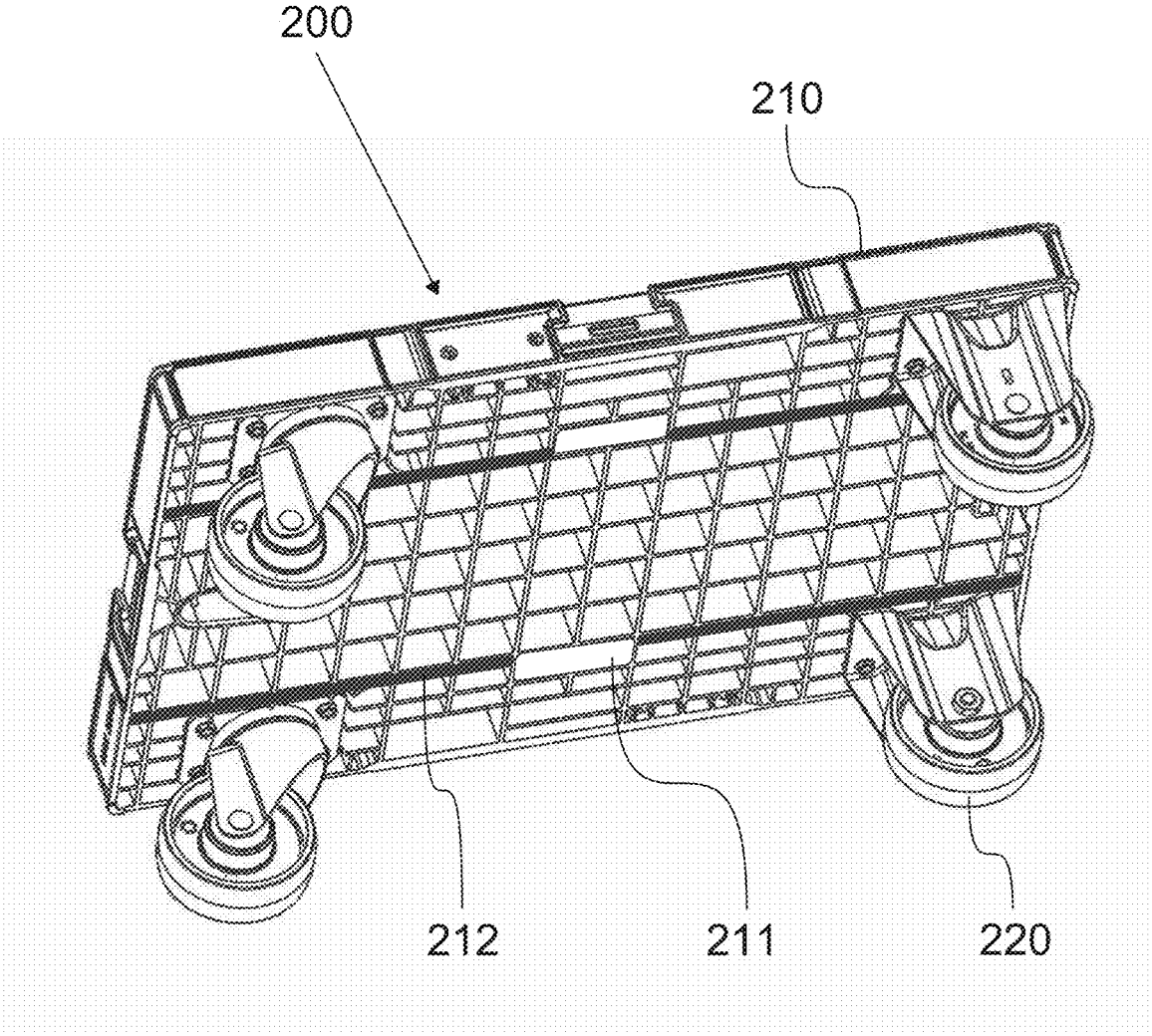
FIG. 4 presents an isometric bottom view of the dolly of FIGS. 1 to 3*c*.

Turning now particularly to FIG. 4, which shows the bottom end of a dolly 200 especially suitable to be used in connection with the present adaptor pallet 100. As can be seen, the dolly 200 includes a chassis 210 and four wheels 220 (or castors) connected to the bottom surface of the chassis 210. The bottom surface of the chassis 210 is the engaging surface, which is intended to engage with that of the lifting structure 120. The engaging surfaces of the lifting structure 120 and the chassis 210 of the dolly 200 are equipped with cooperating interlocking forms 121, 211 for locking the lifting structure 120 and dolly 200 to each other. In the illustrated embodiment, the lifting structure 120 features the above mentioned fins 121, which are configured to connect to the recesses 211 provided to the plastic chassis 210 of the dolly 200 by molding. For assisting the relative movement between the engaging surfaces of the dolly 200 and lifting structure 120, grooves 212 have been provided to the bottom surface of the chassis 210 of the dolly 200 in the longitudinal direction, which the dolly 200 shares with the adaptor pallet 100.

Turning now to FIGS. 2*a* to 2*c* and 3*a* to 3*c*, which illustrate the operation of the adaptor pallet 100. The dollies 200 are propelled onto the adaptor pallet 100, when the adaptor pallet is in released configuration. This means that at least one or both lifting structures 120 are in a released state. If the adaptor pallet 100 does not feature a biasing spring forcing the lifting structures 120 towards the dolly 200, the lifting structure 120 remains in the released state by means of gravity, which pulls the frame 122 downward. If the adaptor pallet 100 does feature a biasing spring as described above, the lifting structure 120 is forced down against the force acting via the biasing spring by depressing the pedal 124 or similar piece for manipulating the lifting structure 120. When the lifting The dollies 200 are propelled onto the adaptor pallet 100 in the longitudinal direction from either end or both ends, which is indicated by straight arrows in FIGS. 3*a* and 3*b*.

When the dollies 200 are onboard, the lifting structure 120 is brought into contact with the dolly 200 by releasing the lifting structure 120 to spring up, where applicable, or by introducing the lifting device, such as lifting forks 300, beneath the lifting structures 120 and raising them, or both. When the lifting structures 120 are raised, they pivot in respect to the base 110 and the engaging surfaces of the lifting structure 120 and dolly 200 mate, wherein the interlocking forms 121, 211 lock into place. The adaptor pallet is now in a secured configuration, whereby the dollies 200 are secured to the adaptor pallet 100 for preventing fall-outs.

When the raising motion of the lifting device 300 is continued, the adaptor pallet 100 is raised off the ground 400, whereby the lifting structure 120 supports the weight of the dolly 200 directly from beneath. The lifting structure 120 is thus configured to directly support the weight of the dolly 200 from beneath such that at least 75 percent, particularly at least 95 percent, of the weight of the dolly 200 is supported by the lifting structure and wherein at most 25 percent, particularly at most 5 percent, of said weight is supported by the base 110. In other words, the lifting structure 120 is constructed to support the weight of the dolly 200 directly from its chassis 210, whereby the base 110 of the adaptor pallet 100 carries minimal or no amount of the weight of dollies 200 via the wheels 220 thereof.

Once the plurality of dollies 200 has been transported by means of the lifting device 300 and the adaptor pallet 100 and returned to the ground 400, the lifting device 300 is retracted from beneath the lifting structures 120. If the adaptor pallet 100 does not feature the afore-mentioned biasing spring, the lifting structures 120 drop down by means of gravity and are left supported by the stands 125. The adaptor pallet 100 is therefore returned to the released configuration automatically. If, however, the adaptor pallet 100 does include the biasing mechanism, the adaptor pallet 100 may be brought into the released configuration by forcing the lifting structures 120 away from the dollies 200 by depressing the pedal 124.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. An adaptor pallet for transporting a plurality of dollies, the adaptor pallet comprising:

a base shaped to receive adjacent wheels of at least two parallel dollies, and two lifting structures, one on either side of the base and extending therefrom so as to receive a lifting device for lifting the adaptor pallet from beneath, wherein the two lifting structures are each configured to directly support the weight of a respective one of the at least two parallel dollies from beneath upon lifting motion of the adaptor pallet by means of the lifting device, such that no more than 25% of the weight of a lifted dolly is supported from beneath by the base.

2. The adaptor pallet according to claim 1, wherein the two lifting structures are each constructed to engage with a respective one of the at least two parallel dollies upon lifting motion such that the base of the adaptor pallet carries no more than a minimal amount of the weight of dollies.

3. The adaptor pallet according claim 1, wherein the base is shaped to form at least one track for receiving adjacent wheels of at least two parallel dollies.

4. The adaptor pallet according to claim 1, wherein the lifting structure is arranged movably to the base.

5. The adaptor pallet according to claim 1, wherein the lifting structure is pivoted with respect to the base.

6. The adaptor pallet according to claim 1, wherein:

the dolly comprises a chassis to which the wheels are attached, and wherein the lifting structure is configured to support the weight of the dolly from the chassis of the dolly.

7. The adaptor pallet according to claim 1, wherein:

the adaptor pallet has two opposing ends, defined by a predominant extension of the base, and wherein the lifting structure comprises a frame including:

two articulated arm portions, which are pivotably arranged to the two ends of the base, and an extending portion, which extends between the articulated arm portions.

8. The adaptor pallet according to claim 7, wherein the adaptor pallet comprises a hinge provided between the base and the frame of the lifting structure such as to pivot the lifting structure about an axis parallel to the direction of the predominant extension of the base.

9. The adaptor pallet according to claim 8, wherein the hinge is configured to bias the lifting structure towards the dolly.

10. The adaptor pallet according to claim 9, wherein the dolly comprises a chassis and wherein engaging surfaces of the lifting structure and the chassis of the dolly are equipped with interlocking forms for locking the lifting structure and dolly to each other.

11. The adaptor pallet according to claim 8, wherein the dolly comprises a chassis and wherein engaging surfaces of the lifting structure and the chassis of the dolly are equipped with interlocking forms for locking the lifting structure and dolly to each other.

12. The adaptor pallet according to claim 7, wherein the dolly comprises a chassis and wherein engaging surfaces of the lifting structure and the chassis of the dolly are equipped with interlocking forms for locking the lifting structure and dolly to each other.

13. The adaptor pallet according to claim 1, wherein the dolly comprises a chassis and wherein the engaging surfaces of the lifting structure and the chassis of the dolly are equipped with interlocking forms for locking the lifting structure and dolly to each other.

14. A method of transporting a plurality of dollies by means of an adaptor pallet, the method comprising the steps of:

first receiving wheels of the plurality of dollies to a base of the adaptor pallet, raising lifting structures of the adaptor pallet by means of a lifting device from beneath, upon lifting motion of the lifting device causing angular movement between the base and lifting structures of the adaptor pallet for contacting the lifting structures with chassis of the dollies from beneath, and supporting the weight of the dollies directly from the chassis of the dollies via the lifting structures.

15. The method of claim 14, wherein the adaptor pallet comprises:

said base shaped to receive adjacent wheels of at least two parallel dollies, and two lifting structures, one on either side of the base and extending therefrom so as to receive a lifting device for lifting the adaptor pallet from beneath, wherein the lifting structure is configured to directly support the weight of the dolly from beneath upon lifting motion of the adaptor pallet by means of the lifting device.

* * * * *